United States Patent [19]

Kaps

[11] 4,392,447

[45] Jul. 12, 1983

[54] OFFSHORE MOORING SYSTEM

[75] Inventor: Hermann Kaps, Bremen, Fed. Rep. of Germany

[73] Assignees: Howaldtwerke - Deutsche Werft Aktiengesellschaft Hamburg und Kiel, Kiel; LGA Gastechnik GmbH, Remagen, both of Fed. Rep. of Germany

[21] Appl. No.: 294,333

[22] Filed: Aug. 19, 1981

[30] Foreign Application Priority Data

Aug. 22, 1980 [DE] Fed. Rep. of Germany ..... 3031717

[51] Int. Cl.[3] ..... B63B 21/20

[52] U.S. Cl. ..... 114/230

[58] Field of Search ..... 114/230, 218, 213–217, 114/249–254

[56] References Cited

U.S. PATENT DOCUMENTS

| | | | |
|---|---|---|---|
| 323,639 | 8/1885 | Cowden | 114/250 |
| 3,353,512 | 11/1967 | Mathews | 114/250 |
| 3,677,597 | 7/1972 | Stipek | 114/230 |
| 3,750,723 | 8/1973 | Schirtzinger | 114/230 |
| 3,973,511 | 8/1976 | Balston | 114/218 |
| 4,041,887 | 8/1977 | Paul | 114/230 |
| 4,281,511 | 8/1981 | Vilain | 114/230 |
| 4,254,521 | 3/1981 | Papmahl | 114/230 |

*Primary Examiner*—Trygve M. Blix
*Assistant Examiner*—Stephen P. Avila
*Attorney, Agent, or Firm*—Jon M. Lewis

[57] ABSTRACT

In an offshore mooring system for seagoing vessels, a mooring hawser formed into a loop is resiliently fastened with both its ends around a tower head of an offshore tower. The hawser is kept in readiness beneath a jib of the tower and is spread open by spreading lines running over spreader arms. Spreader blocks are provided for lowering and slackening the spreading-lines so that the hawser can be laid around a bitt on the vessel. The bitt is provided on the forecastle of the vessel on a cradle or platform for bringing the bitt to a position ahead of the bow of the vessel, so that the bitt is positioned substantially beneath the hawser which is spread open for mooring. Mooring operations are made possible by the invention obviating undesirable manual work, even in high seas and rough winds.

10 Claims, 5 Drawing Figures

OFFSHORE MOORING SYSTEM

BACKGROUND OF THE INVENTION

The present invention relates to an offshore mooring system for seagoing vessels.

The mooring system of the invention is for an off shore tower the function of which is facilitate transfer of liquid gas or other liquids to vessels. The liquids are led through pipelines to the tower from an intermediate store, and from the tower via flexible hoses to the seagoing vessel. The offshore tower is anchored via a joint to a foundation plate on the bottom of the sea and its column is a buoyant body. Offshore towers of this kind are used in the open sea where storm and rough sea often occur. It is difficult and dangerous to moor a vessel on an offshore tower.

Usually a messenger line hanging on the jib of an offshore tower which may be an offshore tower or one floating in the water, has to be seized and the end of the mooring hawser attached to the messenger line and has to be drawn on board.

It is an object of the invention to provide a means for mooring a vessel to an offshore tower by which the mooring operations can be accomplished mechanically even under adverse conditions without manual work and without the assistance of auxiliary ships.

Another object of the invention is to provide a mooring system by which the mooring hawser is protected against the corrosive influence and the deleterious conditions in the sea.

Another object of the invention is to improve shipside mooring means for improved co-operation with mooring means on an offshore tower according to this invention.

BRIEF SUMMARY OF THE INVENTION

In an offshore mooring system for seagoing vessels a mooring hawser of definite length formed to a wide loop is arranged beneath the jib of an articulated tower and is lowerable to catch the bitt of a vessel. The mooring hawser is fastened with its two ends turnable to the articulated tower above the waterline. The loop is spreaded open by spreader lines which are guided over spreader arms. In a stand-by position the middle part of the loop is drawn up. When a vessel approaches the loop is lowered immediately to the bitt on the vessel, and after the bitt is under the loop the spreader lines are further slackened so that the mooring hawser captures the bitt.

In a preferred embodiment a bifurcated spreader boom pivoted on the tower head is used to form a trapezoidal loop.

As shipside mooring element a bitt in form of an upright bollard drum is mounted on the forecastle of a vessel by means which bring the bitt in a position ahead of the bow of the vessel for the mooring operation. The bitt is hinged and is retained in an upright position, and, by being bilted when necessary it releases the mooring hawser.

DRAWINGS

DESCRIPTION OF THE PREFERRED EMBODIMENTS

Figure 1:
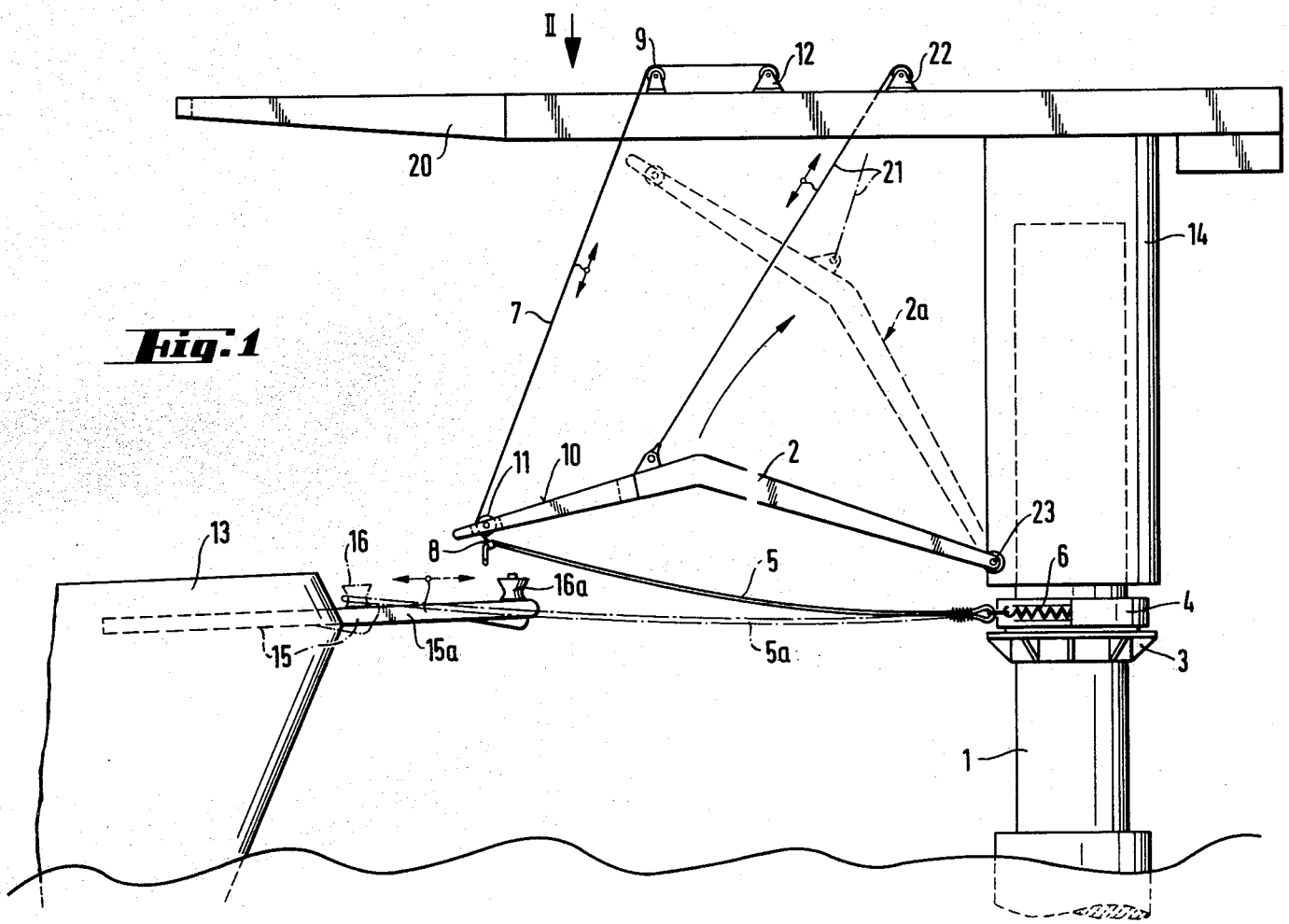
FIG. 1 is a side view of the upper end of an offshore tower with a spreader boom and a mooring hawser of this invention and of the bow of a vessel with a bitt in a position before the mooring hawser is laid around the bitt and the bitt in a normal operating position.

An offshore tower is anchored to the bottom of the sea. As is shown in FIG. 1 the upper end of the column 1 of the offshore tower is above the waterline and carries a rotatable tower head 14 provided with a jib 20. The jib 20 supports the flexible hoses (not shown) for transferring e.g. a liquid to a vessel. A mooring hawser 5 is hanging beneath the jib 20. The mooring hawser 5 is spreaded open to a wide loop, until it is lowered to a bitt 16 on a vessel 13 thereby catching the bitt 16. By astern movement of the vessel the mooring hawser 5 is stretched and kept taut during the loading operation by a slight constant pull the vessel exerts on the mooring hawser.

The mooring hawser 5 of the present invention has a definite length, and its ends are fastened at two opposite points of a turnable collar 4 which rests on a turntable 3 mounted around the column 1. The ends of the mooring hawser 5 are attached to the collar 4 via damping elements 6 such as damping springs. The collar 4 is mounted as high on the column 1 as the average height of the bitts 16 on the bows or forecastles of the vessels 13 or tankers to be moored at the offshore tower. The mooring hawser 5 is handled by means for keeping it in a stand-by position, and for lowering and withdrawing it in connection with mooring operations.

Before a mooring operation the tower head 14 is fixed in a position to suit the prevailing environmental conditions and the mooring hawser 5 is held spreaded open to a wide loop above the height of the bitt 16 on a vessel approaching the articulated tower. The mooring hawser 5 is kept by blocks which in the following are named spreader blocks 8 because they are used for spreading the hawser 5 to a loop. The spreader blocks 8 are attached to spreader lines 7 which are guided by guide rollers 11 at the ends of spreader arms 10 of a bifurcated spreader boom 2. The spreader boom is located beneath the jib 20. The spreader lines 7 are further led over guide rollers 9 on the jib 20 to a spreader line winch 12 which is mounted on the jib 20.

The spreader boom 2 is hinged on a horizontal axis 23 on the tower head 13 and can be moved up and down by a topping lift wire 21 operated by a topping lift winch 22 on the jib 20.

The stand-by position of the spreader boom 2 is shown as item *2a* in dotted lines in FIG. 1. When a vessel 13 approaches, the spreader boom 2 is lowered to the position shown in full lines. In this position the mooring hawser 5 is still pulled taut by the spreader blocks 8, and thereby kept open to a loop of approximately a trapezoidal shape. At least the middle part of the mooring hawser 5 is now still above the height of the bitt 16 of the vessel 13.

Figure 2:
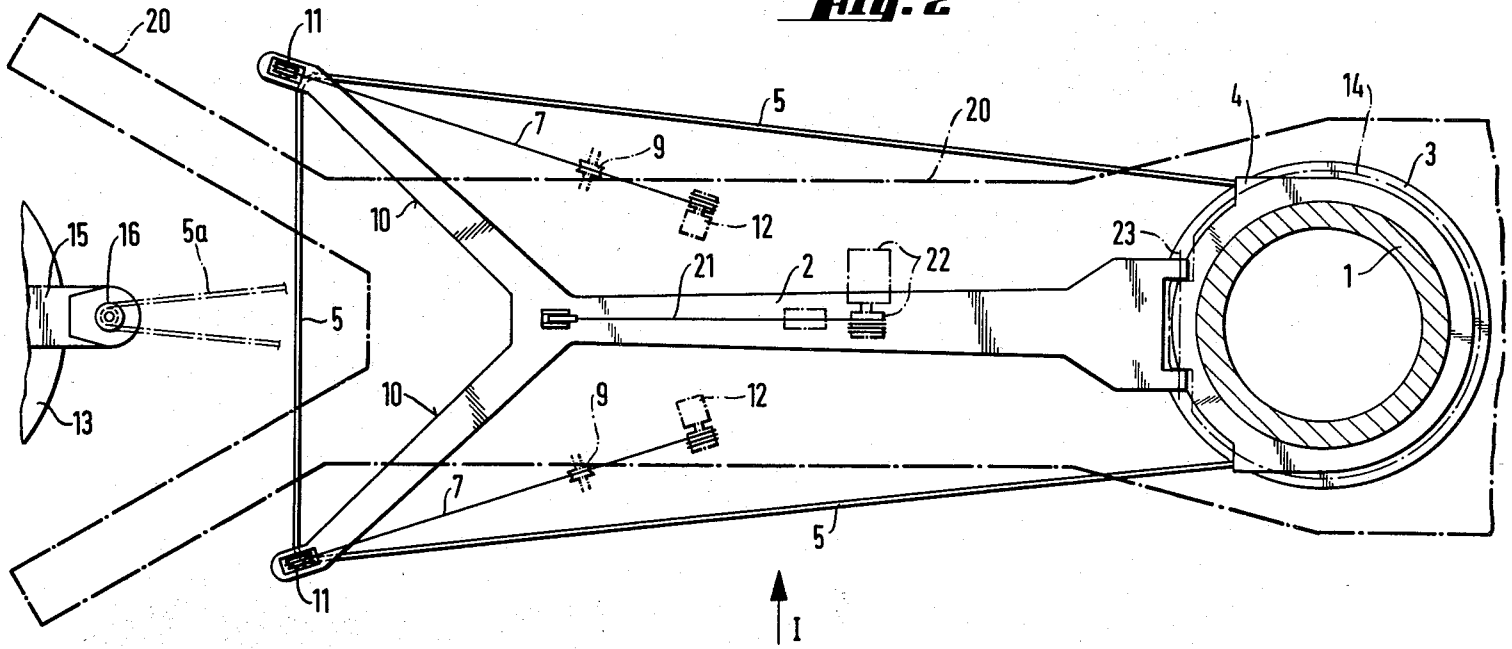
FIG. 2 is a plan view on the spreader boom and the mooring hawser according to FIG. 1.

When the bitt 16 comes under the loop, the mooring hawser 5 is lowered by slackening the spreader lines 7 so that the hawser embraces the bitt 16. By slow retracting movement of the bitt, and/or of the vessel, the mooring hawser 5 can be stretched to a position 5*a* as shown in FIGS. 1 and 2.

Figure 3:
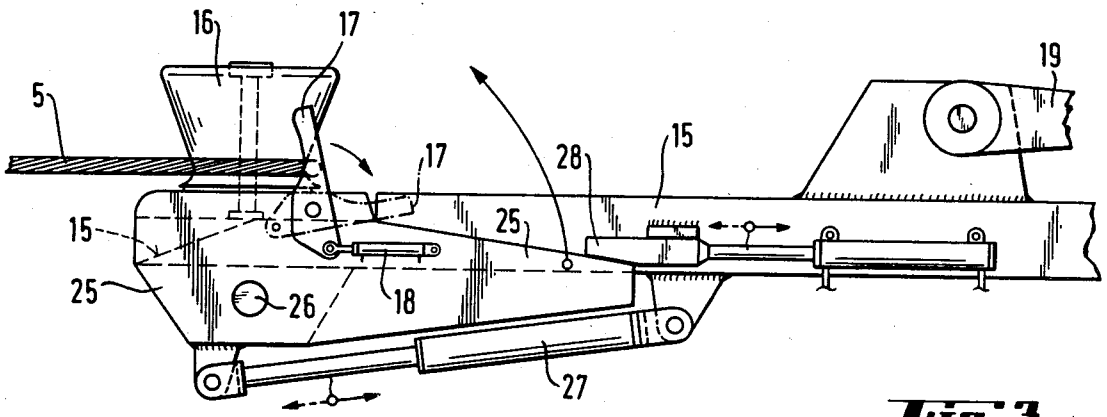
FIG. 3 is an enlarged side view on the shipside mooring installation as shown in FIG. 1.

The shipside mooring elements as illustrated in FIG. 3 comprise a sliding cradle 15 mounted on the forecastle of the vessel 13 in which a bitt plate 25 is pivoted on a horizontal axis 26. The bitt 16 is mounted on the bitt plate 25 freely rotating on a bearing. The bitt 16 has the shape of an upstanding bollard drum with flaring sides. The upper diameter of the bitt is larger than the diameter at the bottom of the bitt. The cradle 15 with the bitt 16 is extensible by means of a hydraulically operated lever 19 to a position ahead of the bow. When the mooring hawser has sufficiently embraced the bitt 16, it can be clamped by a pair of securing levers 17 actuated by hydraulic means 18. The bitt 16 is secured in its normal position by a retaining chock 28. The bitt plate 25 with bitt 16 can be tilted by hydraulic means 27 for releasing the mooring hawser, if the retaining chock 28 is withdrawn.

In FIG. 1 cradle 15 and bitt 16 are shown in the position in which the cradle is extended, and in this position they are numbered as cradle 15*a* and bitt 16*a*. Withdrawing the cradle and/or the vessel to their position numbered as 15 and 16 the mooring hawser is laid around the bitt 16 and is tightened to its position 5*a*, thereby rotating the bitt if necessary.

When the vessel is moored the spreader boom 2 can be elevated to about its position 2*a*, but the spreader lines 7 remain slack so that they do not lift or spread the mooring hawser 5*a*.

For a release operation the bitt 16 is tilted so that the mooring hawser 5 can slide and disengage from it, whereupon the mooring hawser is pulled up by the spreader lines 7 until the spreader blocks 8 are near the ends of the spreader arms 10.

Figure 4:
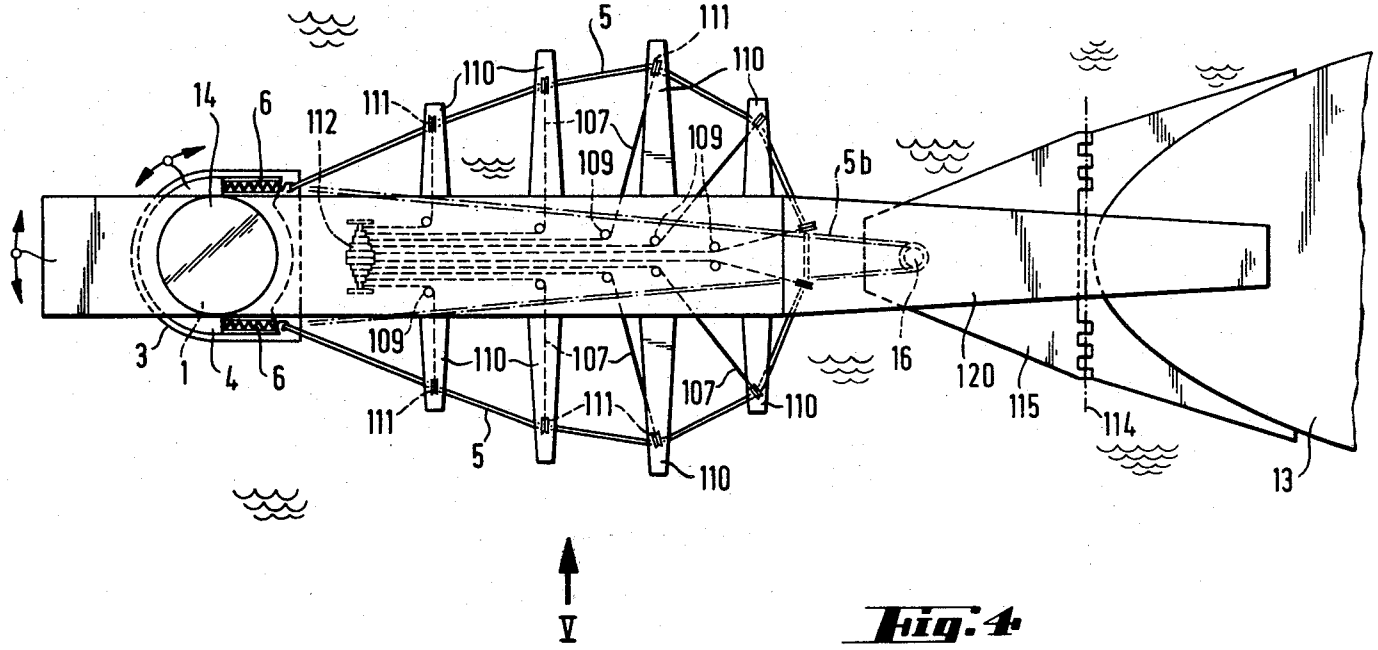
FIG. 4 is a plan view on a jib of an offshore tower and a mooring hawser according to an second embodiment of the invention.
Figure 5:
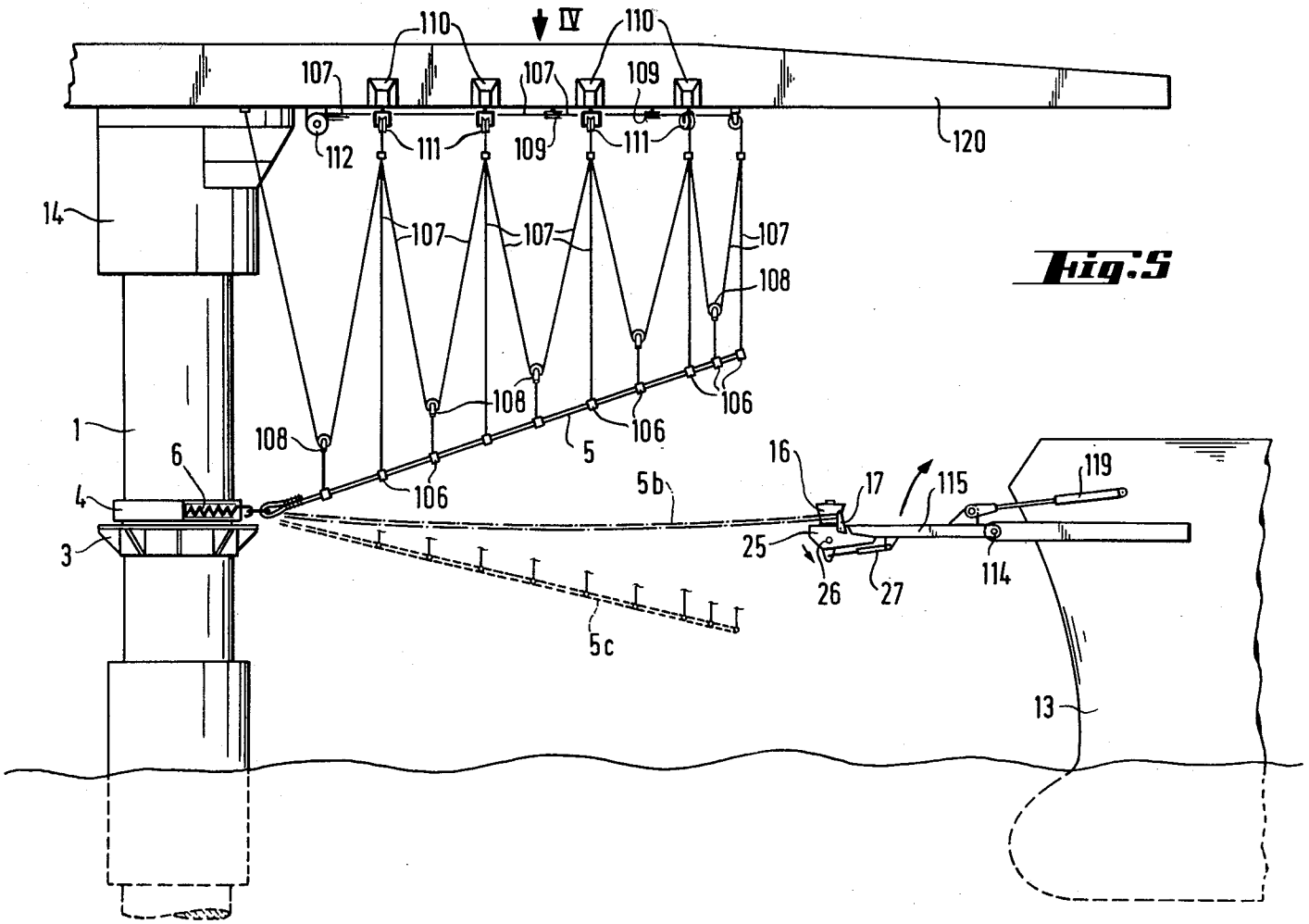
FIG. 5 is a side view of the embodiment of FIG. 4.

In the alternate embodiment shown in FIGS. 4 and 5 spreader arms 110 are mounted on a jib 120 as cross bars. There are guide rollers 111 fitted at the ends of the spreader arms 110, and spreader lines 107 run downward from the guide rollers 111 to spreader blocks 106 which retain the mooring hawser 5. Some of the spreader blocks 106 are connected with compensating pulleys 108 on compensating lines each between a pair of spreader lines 107. The spreader lines 107 are led via guide rollers 109 to a spreader line winch 112 with drums of different diameter so that spreader lines at a greater distance from the offshore tower are moved more than those at a shorter distance. In this embodiment the mooring hawser is spread open to a wide round loop under which the bitt of a vessel can be moved. The mooring hawser 5 hanging below the jib 120 is lowered as soon as the bitt 16 is under the loop until the bitt is caught, and the mooring hawser is extended to position 5*b* by astern movement of the vessel while the spreader lines 107 are slackened.

The mooring hawser 5 according to both the embodiments can be kept in readiness for a mooring operation at any height suitable for the vessel to be moored. If a small ship is expected it can be lowered to position 5*c* as shown in FIG. 5.

FIGS. 4 and 5 show also an alternate embodiment of the shipside mooring elements. A bitt platform 115 is hinged and connected via a horizontal axis 114 with a structure on the bow of the vessel and can be folded up and down by hydraulic means 119. The bitt plate 25 with the rotatable bitt 16 is mounted in the bitt platform and pivoted on a horizontal axis 26. Thus the bitt 16 can be tilted by hydraulic means to release the mooring hawser as described before.

With the arrangements according to the invention a mooring operation can be accomplished without any undesirable manual operations or manual work. It is possible to turn the tower head with the loop of the mooring hawser hanging beneath its jib and to control the winches from the ship. As the loop is wide, e.g. as broad as the beam of a great vessel, it is not difficult to manoeuver the vessel so that the bitt comes under the loop. The mooring hawser is always kept at a certain height above the water so that it cannot be damaged by rough sea.

What is claimed is:

1. An offshore mooring system for seagoing vessels comprising in combination:

(a) an offshore tower comprising a turnable tower head at its upper end above the waterline and a jib on the tower head, (b) a mooring hawser of predetermined length both ends of said mooring hawser being fastened to a collar means capable of rotary movement around the upper end of the offshore tower, said mooring hawser being suspended beneath the jib, (c) a mooring bitt on the forecastle of a vessel which is to be moored, (d) mechanical means for automatically spreading open and holding said mooring hawser open to form a wide loop above the height of the bitt of the vessel when the vessel has approached the tower, and for lowering the spread open loop of said mooring hawser over the bitt thereby capturing the bitt by the loop, wherein said mechanical means for spreading open and holding the mooring hawser comprises spreader blocks for retaining the mooring hawser and for spreading it open to a loop, said spreader blocks being movable by spreader lines connected to the spreader blocks, said system including means to wind and unwind said spreader lines.

2. An offshore mooring system for seagoing vessels comprising in combination:

(a) an offshore tower comprising a turntable tower head at its upper end above the waterline and a jib on the tower head, (b) a mooring hawser of predetermined length, both ends of said mooring hawser being fastened to a collar means capable of rotary movement around the upper end of the offshore tower, said mooring hawser being suspended beneath the jib, (c) a mooring bitt on the forecastle of a vessel which is to be moored, (d) mechanical means for automatically spreading open and holding said mooring hawser open to form a wide loop above the height of the bitt of the vessel when the vessel has approached the tower, and for lowering the spread open loop of said mooring hawser over the bitt thereby capturing the bitt by the loop, wherein said mechanical means for spreading open and holding the mooring hawser comprises spreader blocks for retaining the mooring hawser and for spreading it open to a loop, said spreader blocks being movable by spreader lines connected to the spreader blocks, said system including means to wind and unwind said spreader lines the system including guide rollers over which the spreader lines run, and a spreader line winch for lowering the mooring hawser during a mooring operation and for withdrawing it thereafter.

3. An offshore mooring system as claimed in claim 2 further comprising a spreader boom having overhanging spreader arms and being mounted on the offshore tower beneath the jib, the free ends of the spreader arms of the spreader boom supporting said guide rollers for the spreader lines.

4. An offshore mooring system as claimed in claim 3 in which the spreader boom is bifurcated to form said spreader.

5. An offshore mooring system as claimed in claim 3 in which the spreader boom is hinged to the tower head and is movable angularly up and down by means of a topping lift wire.

6. An offshore mooring system for seagoing vessels comprising in combination:

(a) an offshore tower comprising a turnable tower head at its upper end above the waterline and a jib on the tower head, (b) a mooring hawser of predetermined length, both ends of said mooring hawser being fastened to a collar means capable of rotary movement around the upper end of the offshore tower, said mooring hawser being suspended beneath the jib, (c) a mooring bitt on the forecastle of a vessel which is to be moored, (d) mechanical means for automatically spreading open and holding said mooring hawser open to form a wide loop above the height of the bitt of the vessel when the vessel has approached the tower, and for lowering the spread open loop of said mooring hawser over the bitt thereby capturing the bitt by the loop, wherein said mechanical means for spreading open and holding the mooring hawser comprises spreader blocks for retaining the mooring hawser and for spreading it open to a loop, said spreader blocks being movable by spreader lines connected to the spreader blocks, said system including means to wind and unwind said spreader lines, the system further comprising a plurality of spreader arms mounted as cross bars on the jib, the free ends of the spreader arms supporting guide rollers, said spreader lines running over the guide rollers, the system including a spreader line winch for holding the mooring hawser in form of a loop, for lowering it during a mooring operation and for withdrawing it thereafter.

7. A offshore mooring system as claimed in claim 1 further comprising on the forecastle of the vessel means a cradle means supporting said bitt in a hinged manner about a horizontal axis, and retractable means for advancing the cradle together with said bitt into a position ahead of the bow of the vessel for being engaged by the mooring hawser and further remote controlled means for tilting the bitt downwardly about said horizontal axis for releasing the mooring hawser.

8. An offshore mooring system as claimed in claim 7 in which the bitt is mounted on a bitt plate which forms part of said cradle, which bitt plate is pivoted on a horizontal axis in a cradle, which cradle is extensible into a position ahead of the bow of the vessel.

9. An offshore mooring system as claimed in claim 7 in which the bitt has the configuration of an upstanding bollard drum with flaring sides, the upper diameter of the drum being larger than the diameter of the bitt near its bottom said bitt being rotatable about a vertical axis.

10. An offshore mooring system as claimed in claim 7, which includes a remotely operable retaining chock which prevents downward tilting of said bitt about said horizontal axis unless said retaining chock is released.

* * * * *